United States Patent [19]

Cochrane

[11] 4,388,023

[45] Jun. 14, 1983

[54] TRUSS ARRAY FOR SUPPORTING DEVICES WITHIN A FLUID MEDIUM

[75] Inventor: Peter R. Cochrane, Kingston, Mass.

[73] Assignee: Hazeltine Corporation, Greenlawn, N.Y.

[21] Appl. No.: 250,781

[22] Filed: Apr. 3, 1981

[51] Int. Cl.[3] ..... B63B 21/00

[52] U.S. Cl. ..... 405/195; 405/171

[58] Field of Search ..... 405/195, 203–208, 405/166–171, 63–72, 154, 158

[56] References Cited

U.S. PATENT DOCUMENTS

| | | | |
|---|---|---|---|
| 3,539,013 | 11/1970 | Smith | 405/66 X |
| 3,559,413 | 2/1971 | Silverman | 405/171 X |
| 4,107,933 | 8/1978 | Lamy | 405/171 |
| 4,132,084 | 1/1979 | Francisco-Arnold | 405/171 |
| 4,271,550 | 6/1981 | Joubert et al. | 405/171 X |

*Primary Examiner*—Dennis L. Taylor

*Attorney, Agent, or Firm*—E. A. Onders; F. R. Agovino

[57] ABSTRACT

A primary supporting truss comprising a surface float supporting an anchor within a fluid medium, a subsurface float connected to the anchor and a weight connected to the subsurface float and the anchor is deployed by a drogue by engaging currents within the fluid medium. The drogue is connected to the subsurface float and devices are suspended between the anchor and the subsurface float in a horizontal position. Alternatively, the drogue may be connected to the weight and the devices may be suspended between the anchor and the weight. The apparatus may include a plurality of secondary supporting trusses, each comprising a subsurface float and a weight connected between the primary supporting truss and the drogue for supporting additional devices.

16 Claims, 7 Drawing Figures

TRUSS ARRAY FOR SUPPORTING DEVICES WITHIN A FLUID MEDIUM

BACKGROUND OF THE INVENTION

1. Field of the Invention

The invention relates generally to a support apparatus and, in particular, to apparatus for horizontally supporting devices within a fluid medium.

2. Description of the Prior Art

It is known that a plurality of surface floats may be used to horizontally support devices within a fluid medium such as water. However, such an array of surface floats is visible from above the water, and is subject to surface currents or other forces within the water which affect the horizontal positioning of the devices.

SUMMARY OF THE INVENTION

It is an object of this invention to provide an apparatus which horizontally supports a plurality of devices within a fluid medium.

It is a further object of this invention to provide an automatically deploying apparatus for horizontally supporting devices within a fluid medium.

The invention relates to an apparatus for horizontally supporting one or more devices within a fluid medium of known density. A primary supporting truss comprises the following elements: first means for supporting a first mass at a given position within the fluid medium; a second mass having a density less than the known density of the fluid medium connected to said first mass by second means; and a third mass having a density greater than the known density of the fluid medium connected to the first mass and the second mass by third means. A fourth means for supporting the devices connected to the first mass and means for deploying said apparatus are associated with the primary truss. The means for deploying may be fifth means for engaging currents within the medium and connected to the fourth means. At least one secondary supporting truss may be connected between the primary supporting truss and the fifth means.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
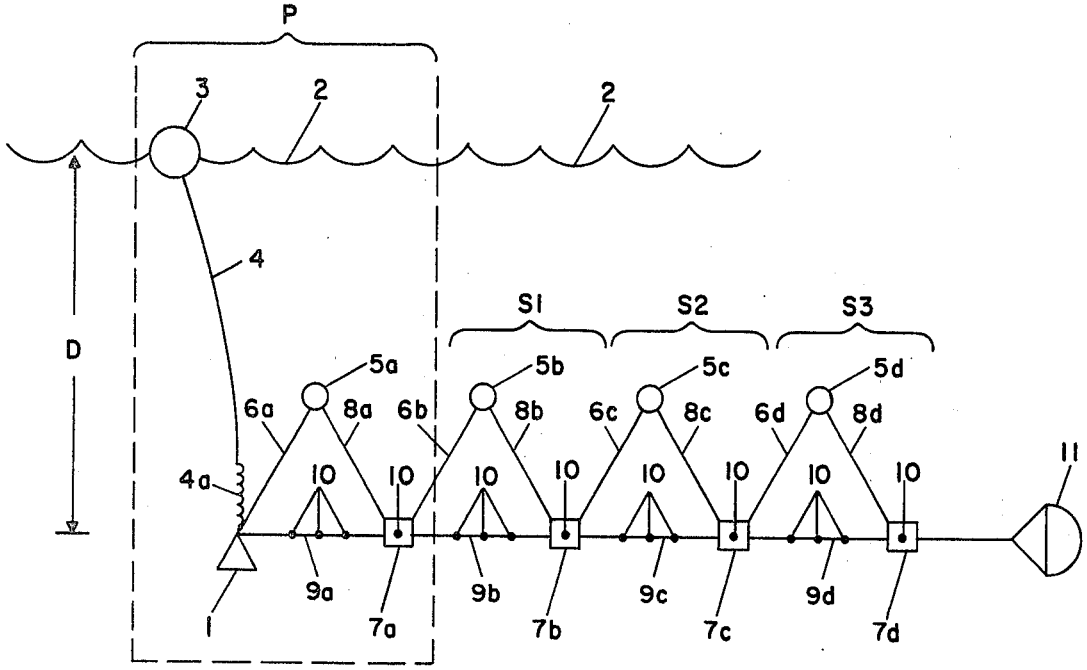
FIG. 1 is an illustration of a preferred embodiment of the invention as deployed within a heavier-than-air fluid medium.

The preferred embodiment of the truss array of the invention as illustrated in FIG. 1 includes a primary supporting truss P, secondary supporting truss S1, secondary supporting truss S2, and secondary supporting truss S3. However, the invention may include any number of secondary supporting trusses.

The primary truss P includes anchor 1 and means for supporting the anchor 1 at a given horizontally stable position within fluid medium 2 of known density. FIG. 1 illustrates a heavier-than-air medium, such as water, wherein anchor 1 is a mass of density greater than the known density of the medium and the means for supporting the anchor at the given position comprises surface float 3 such as a transmitting buoy having a density less than the known density of medium 2 and line 4 interconnecting surface float 3 and anchor 1. A compliant means, such as resilient element **4*a*, may be provided between line float 3 and anchor 1 to isolate the surface movement of float 3 from the subsurface structure of the array. Furthermore, the apparatus according to the invention may include any means for supporting the anchor 1 at a given position within the fluid medium including, but not limited to, the embodiments illustrated in FIGS. 4A–4D** and discussed below.

Primary truss P further includes subsurface float **5*a* having a density less than the known density of the medium and connected to anchor 1 via line 6*a*. Weight 7*a* having a density greater than the known density of the medium is connected to subsurface float 5*a* via line 8*a* and to anchor 1 via line 9*a*. Devices 10 to be horizontally supported within the medium 2 may be connected to or suspended from line 9*a*, anchor 1 or weight 7*a*. Drogue 11 may be connected to weight 7*a* for deploying the apparatus and maintaining the apparatus in a relatively stable position so that devices 10 supported by line 9 are in an approximately horizontal plane. FIG. 1 illustrates drogue 11 connected to weight 7*a* via subarrays S1, S2 and S3. However, the invention may comprise the single primary array P with drogue 11 directly connected to weight 7*a*. In addition, means may be employed with primary array P for determining the direction of orientation of the array. For example, a geophone or flux-gate compass may be supported by anchor 1 or float 3**.

Each line interconnecting the floats, weights, anchor and drogue is preferably a flexible cable. However, any means may be used for interconnection including, but not limited to, rods, ropes, chains, telescoping members or resilient members or any combination thereof.

Each secondary supporting truss, such as secondary trusses S1, S2, and S3 illustrated in FIG. 1, includes a subsurface float **5*b*, 5*c*, 5*d* having a density less than the known density of the fluid medium 2. Each secondary truss also includes a weight 7*b*, 7*c*, 7*d* having a density greater than the known density of the fluid medium 2**.

In the embodiment as illustrated in FIG. 1, each subsurface float **5*b*, 5*c*, 5*d* of each secondary truss S1, S2, S3 is connected to the weight 7*a*, 7*b*, 7*c*, respectively, of the last adjacent truss. In particular, secondary truss S1 is connected to primary truss P so that subsurface float 5*b* of the secondary truss S1 is connected to weight 7*a* of the last adjacent truss (primary truss P) via line 6*b***.

Each weight **7*b*, 7*c*, 7*d* of each of the secondary trusses S1, S2, S3 is connected to the weight 7*a*, 7*b*, 7*c*, respectively, of the adjacent truss and to the subsurface float 5*b*, 5*c*, 5*d* which is part of the same secondary truss. Specifically, weight 7*b* of the secondary truss S1 is connected via line 8*b* to subsurface float 5*b* and via line 9*b* to weight 7*a*** of adjacent primary truss P.

Additional devices 10 may be connected to line **9*b* and/or weights 7*b*, 7*c*, 7*d* in horizontal line with line 9*a***.

Secondary trusses S2 and S3 are similarly connected, as illustrated. Drogue 11 is connected to the last weight of the last truss of the array which, as illustrated in FIG. 1, is weight *7d*.

In operation, the entire apparatus is released in the medium as a package, preferably with all interconnecting lines coiled. Upon release, surface float 3 begins to float and anchor 1 is forced downward by gravity causing line 4 to uncoil into an extended position which defines the depth D of the anchor 1 and, subsequently, the devices 10. Naturally occurring currents in medium 2 deploy drogue 11, which forces lines *9a, 9b, 9c, 9d* to uncoil. Buoyant forces within the medium move subsurface floats *5a, 5b, 5c, 5d* upward completing deployment of the entire array and providing a stable horizontal support for devices 10.

Figure 2:
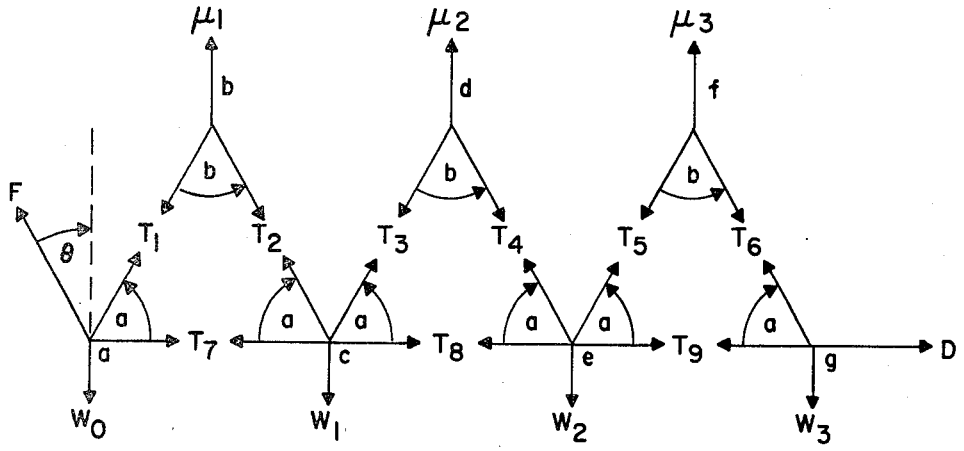
FIG. 2 is a vector diagram of the forces involved in an embodiment of the invention including a primary supporting truss and first and second secondary supporting trusses.

FIG. 2 illustrates the forces involved in an apparatus of the type illustrated in FIG. 1 including a primary truss and two secondary trusses. In particular, force F represents the tension between surface float 3 and anchor 1. Force $W_o$ represents the weight of anchor 1. Forces $U_1$, $U_2$ and $U_3$ represent the upward forces created by subsurface floats *5a, 5b* and *5c*, respectively. Forces $W_1$, $W_2$ and $W_3$ represent the gravitational forces on weights *7a, 7b* and *7c*, respectively. Force D represents the force created by drogue 11. $T_1$–$T_9$ represent the tension in the lines.

Assume that the system is at equilibrium, that the devices 10 have the same density as the medium, and that D is known since the force resulting from naturally occurring shear currents acting on a drogue can be measured or calculated. Choose line lengths 6 and 8 to be equal to form each truss as an isosceles triangle with angles a and b. For convenience, assume $$\text{angle } a = \text{angle } b = 60°$$

Summing the vertical forces, acting on node g, yields $$T_6 \sin 60° - W_3 = 0 \text{ or } T_6 = 1.15 W_3$$

Summing the horizontal forces acting on node g yields $$D - T_6 \cos 60° - T_9 = 0$$

or $T_g = D - 0.5 T_6$

Combining $$T_9 = D - 0.58 W_3$$

In order to create tension in line 9, $0.58W_3$ must be selected to be slightly less than D or $W_3$ must be slightly less than 1.72D. However, if the devices 10 are supported only by the weights, line 9 need not be tensioned. In addition, if D is much greater than $0.58W_3$, D will cause the entire apparatus to move. Since D can be measured or calculated, $W_3$ may be selected to meet these condition and is known.

$T_5$ and $T_6$ are equal since summing the horizontal forces acting on node f yields $$T_6 \cos 60° - T_5 \cos 60° = 0$$

Or $$T_5 = T_6 = 1.15 W_3$$

Therefore, $U_3$ can be determined by summing the vertical forces acting on node f $$U_3 - T_6 \sin 60° - T_5 \sin 60° = 0$$

Or $$U_3 = 2W_3$$

Since the system is at equilibrium and line 9 is a straight line, $T_9 = T_8 = T_7$. $T_4$ and $T_5$ are equal since summing the horizontal forces acting on node e yields $$T_9 + T_5 \cos 60° - T_4 \cos 60° - T_8 = 0$$

$$\text{Or } T_4 = T_5 = 1.15 W_3$$

$W_2$ can now be determined by summing the vertical forces acting on node e.

$$T_5 \sin 60° + T_4 \sin 60° - W_2 = 0$$

Or $$W_2 = 2W_3$$

By similar analysis, it can be shown that $$U_2 = W_1 = U_1 = 2W_3$$

and that $$T_4 = T_3 = T_2 = T_1 = 1.15 W_3$$

Further similar analysis yields that $W_o$ should equal $2W_3$. However, $W_o$ may be chosen much greater than $2W_3$ to quickly deploy the apparatus and enhance its stability at the desired depth D.

The angle $\theta$ between F and $W_o$ can now be found. Summing the vertical forces at node a yields $$F \cos \theta + T_1 \sin 60° - W_o = 0$$

Or $$F = \frac{W_0 - W_3}{\cos \theta} \quad (1)$$

Summing the horizontal forces yields $$T_1 \cos 60° + T_7 - F \sin \theta = 0$$

Or $$F = \frac{D}{\sin \theta} \quad (2)$$

The two unknowns, F and $\theta$, can now be calculated from the two equations (1) and (2) derived from the analysis at node a. Once F is determined, the minimum buoyancy of surface float 3 can be determined. As a result, all forces on all nodes and all angles are known and can be calculated when the apparatus is at equilibrium.

Figure 3:
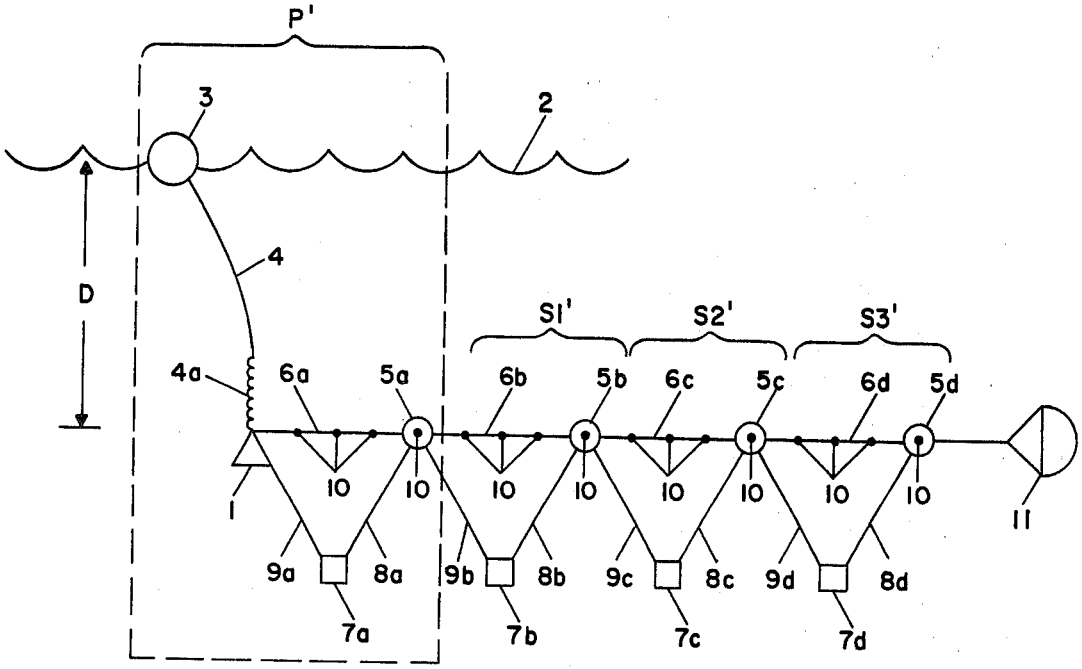
FIG. 3 is an illustration of an alternative embodiment of the invention.

FIG. 3 illustrates an alternative embodiment of the invention wherein like reference numerals refer to the same structure as illustrated in FIG. 1. In the alternative embodiment of FIG. 3, the drogue 11 is connected to the last subsurface float *5d* of the last secondary supporting truss S3'. In addition, each secondary supporting truss S1', S2', S3' is connected to its adjacent truss by connection to the subsurface float *5a, 5b, 5c* of the adjacent truss P, S1', S2', respectively, rather than by connection to the weight of the adjacent truss as illustrated in FIG. 1. For example, secondary supporting truss S1' is connected to subsurface float 5*a* of primary supporting truss P'. The result is that lines 6*a*, 6*b*, 6*c*, 6*d* form the horizontal line to which devices 10 may be connected.

The invention has been described with particular regard to its structure for supporting devices 10 in a horizontally stable position by attachment of the devices to line 9 and/or weights 7*a*, 7*b*, 7*c*, 7*d* of FIG. 1 or line 6 and/or floats 5*a*, 5*b*, 5*c*, 5*d* of FIG. 3. However, it is contemplated that the devices may be supported in any position which is horizontally stable by varying the support distance between line 9 or line 6 and the devices. For example, devices 10 may be suspended from an arched cable connected to anchor 1 and drogue 11 or may be located at various horizontal positions by suspending the devices from line 6 or line 9 by cables of various length.

Figure 4A:
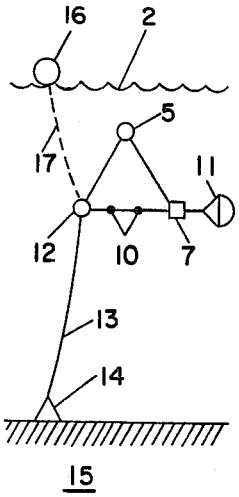
FIGS. 4A–4D are illustrations of alternative embodiments particularly illustrating the means for supporting the anchor at a given position within the fluid medium.
Figure 4B:
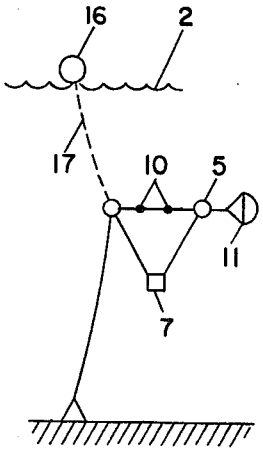
Figure 4C:
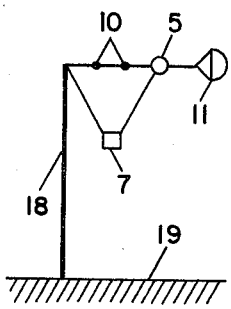
Figure 4D:
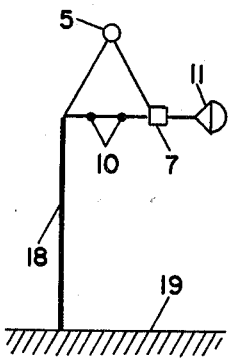

It is contemplated that this apparatus may be used in any fluid medium to support any kind of device. For example, devices such as transducers, antenna elements, lights or any type of sensing or transmitting device may be supported. FIGS. 4A–4D illustrate various means for supporting a primary truss within the fluid medium 2. FIG. 4A illustrates subsurface float 12 connected by line 13 to anchor 14. Anchor 14 may rest on floor 15 or may be suspended from subsurface float 12 by connecting surface float 16 to subsurface float 12 by line 17. Alternatively, float 12 may be eliminated by interconnecting lines 13 and 17. Weight 7 and subsurface float 5 are interconnected between float 12 and drogue 11 for deploying the apparatus. FIG. 4B is an alternative embodiment of FIG. 4A wherein the drogue 11 is connected to float 5 rather than weight 7. FIGS. 4C and 4D illustrate primary trusses wherein the anchor and means for supporting the anchor at a given horizontally stable position comprises a rigid member 18 affixed to base 19.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An apparatus for supporting within a fluid medium of known density one or more devices in a horizontal position, said apparatus comprising:
- a first mass;
- first means for supporting said first mass at a given position within the fluid medium;
- a second mass having a density less than the known density of the fluid medium;
- second means for connecting said second mass to said first mass;
- a third mass having a density greater than the known density of the fluid medium;
- third means for connecting said third mass to said second mass and said first mass;
- means for deploying said apparatus; and
- fourth means for supporting the devices, said fourth means being connected between said first mass and said means for deploying.

2. The apparatus of claim 1 wherein said means for deploying comprises fifth means for engaging currents within the fluid medium.

3. The apparatus of claim 2 wherein said fifth means comprises a drogue connected to said second mass.

4. The apparatus of claim 2 wherein said fifth means comprises a drogue connected to said third mass.

5. The apparatus of claim 2 wherein said first mass has a density greater than said known density; and
- said first means comprises a fourth mass having a density less than said known density and means for interconnecting said fourth mass and said first mass.

6. The apparatus of claim 5 wherein said means for interconnecting comprises a flexible compliant member.

7. The apparatus of claim 2 wherein the combination of said first mass, said second mass, said third mass, said first means, said second means and said third means comprises a primary supporting truss, said apparatus further comprising at least one secondary supporting truss connected between said primary supporting truss and said fifth means.

8. The apparatus of claim 7 wherein said secondary supporting truss comprises:
- a fifth mass having a density less than the known density of the fluid medium;
- sixth means for connecting said fifth mass to said third mass;
- a sixth mass having a density greater than said known density;
- seventh means for connecting said sixth mass to said fifth mass and said third mass; and
- eighth means for supporting said devices, said eighth means being connected between said first mass and said fifth means.

9. The apparatus of claim 8 wherein said fourth means and said eighth means comprises a first flexible linear member interconnecting said first mass, sai third mass, said sixth mass and said fifth means.

10. The apparatus of claim 9 wherein said sixth means comprises a second flexible linear member and said seventh means comprises a pair of flexible linear members.

11. The apparatus of claim 7 wherein said secondary supporting truss comprises:
- a fifth mass having a density less than the known density of the fluid medium;
- ninth means for connecting said fifth mass to said second mass;
- a sixth mass having a density greater than said known density;
- tenth means for connecting said sixth mass to said fifth mass and said second mass; and
- eleventh means for supporting the devices connected between said first mass and said fifth means.

12. The apparatus of claim 11 wherein said fourth means and said eleventh means comprises a first flexible linear member interconnecting said first mass, said second mass, said fifth mass and said fifth means.

13. The apparatus of claim 12 wherein said ninth means comprises a second linear member and said tenth means comprises a pair of flexible linear members.

14. The apparatus of claim 9 or 12 wherein said second means comprises a second flexible linear member and said third means comprises a pair of flexible linear members.

15. The apparatus of claim 2, 7 or 11 wherein said fifth means comprises a drogue.

16. The apparatus of claim 15 further including means for determining the direction of orientation of the array.

* * * * *